US005094399A

United States Patent [19]

Zaber

[11] Patent Number: 5,094,399

[45] Date of Patent: Mar. 10, 1992

[54] APPLICATION OF THERMAL-CURE MATERIALS

[75] Inventor: Robert J. Zaber, Detroit, Mich.

[73] Assignee: Technadyne Engineering Corporation, Detroit, Mich.

[21] Appl. No.: 518,972

[22] Filed: May 4, 1990

Related U.S. Application Data

[63] Continuation-in-part of Ser. No. 248,918, Sep. 26, 1988, abandoned.

[51] Int. Cl.[5] ..... B05B 1/24; B05B 1/34; B05B 9/03

[52] U.S. Cl. ..... 239/135; 239/332; 239/583; 239/590

[58] Field of Search ..... 239/135, 124, 332, 373, 239/583, 595; 427/421

[56] References Cited

U.S. PATENT DOCUMENTS

| | | | |
|---|---|---|---|
| 3,348,520 | 10/1967 | Lockwood | 239/135 |
| 3,556,403 | 1/1971 | Manginelli | 239/135 |
| 4,329,380 | 5/1982 | Johansen et al. | 427/421 |
| 4,387,851 | 6/1983 | Dick | 239/135 |
| 4,527,712 | 7/1985 | Cobbs, Jr. et al. | 239/135 |
| 4,569,480 | 2/1986 | Levey | 239/135 |
| 4,721,252 | 1/1988 | Colton | 239/135 |
| 4,785,996 | 11/1988 | Ziecker et al. | 239/135 |

*Primary Examiner*—Andres Kashnikow
*Attorney, Agent, or Firm*—Barnes, Kisselle, Raisch, Choate, Whittemore & Hulbert

[57] ABSTRACT

A system for extruding or spraying high molecular weight thermal-cure thixotropic material, such as structural epoxy, includes apparatus for supplying the material at constant flow rate and heating the material to elevated temperature above ambient. An extrusion nozzle has an inlet manifold in which flow of heated material is divided into a least two parallel flow paths. An extrusion head includes a cavity having a dimension perpendicular to the paths and into which the flow paths open at one longitudinal edge of the cavity. Side and end walls of the cavity taper narrowingly in the opposite direction to a rectangular orifice extending along the inlet-remote edge of the cavity. A spray nozzle includes a inlet manifold having a ball-type valve at its outlet for imparting shear stresses to thixotropes in the material exiting the manifold outlet, and thereby reducing material viscosity during passage through a transition chamber which extends from the valve to a spray tip. The length of the transition chamber in the direction of material flow is sufficient to permit activated thixotropes in the material to decrease viscosity sufficiently for airless spraying at the spray tip.

18 Claims, 4 Drawing Sheets

APPLICATION OF THERMAL-CURE MATERIALS

This application is a continuation-in-part of application Ser. No. 248,918 filed Sept. 26, 1988, now abandoned.

The present invention is directed to a system and method for spraying or extruding ribbons or patches of high molecular weight polymeric thermal-cure thixotropic material, such as single-component structural epoxy, for joints, body panel reinforcement and like applications.

Many processes and techniques have heretofore been proposed for applying materials to substrates, such as spraying materials onto panels. Prior art spray processes in particular operate with low viscosity materials, such as paint having a viscosity on the order of 100 poise, at relatively low pressure on the order of no more than about 100 psi. The present invention deals with application of high molecular weight polymeric thermal-cure materials at elevated temperature (e.g., 120° F.) having a viscosity greater than 1000 centipoise as heated, and at pressures at or above 1500 psi. Simply stated, the art is devoid of any proven technique for spraying high molecular weight polymeric thermal cure thixotropic materials of this character.

For purposes of the present application, the term "spraying" refers to breakup of the material into small particles or droplets that are broadcast onto a substrate in a pattern, such as a fan, sheet or cone pattern, that has a width at the point of deposition on the substrate that is many times the diameter of the spray nozzle opening. Spraying is thus to be distinguished from "flowing" or "extruding" where the material at the point of deposition has a dimension that is about the same a the dimension of the opening. "High molecular weight" polymeric material refers to material having a molecular weight of at least 360 MWn. Structural epoxies, for example, typically have a molecular weight of at least 600 MWn.

The present invention is directed to a method and system for spraying high molecular weight polymeric thermal-cure thixotropic materials, and to a system for extruding such materials. In accordance with those aspects of the invention that feature spraying of such materials, the material, having a viscosity greater than 1000 centipoise, is fed at pressure at or above about 1500 psi through a device for applying shear forces to the material and thereby activating the thixotropes therein. Immediately following such activation of the thixotropes, the material is held in a chamber for a time sufficient to permit the activated thixotropes to reduce viscosity of the material to a level no greater than about 50% of the thixotropic stable viscosity. The material at such reduced viscosity is then directed through an orifice into ambient air at atmospheric pressure. The material at reduced viscosity and atmospheric pressure breaks up into droplets and forms an expanded pattern, preferably a flat spray pattern, that is many times the size of the spray orifice.

Preferably, the material is provided at constant volumetric flow rate through the shearing mechanism, through a transition chamber, to the spray orifice. The transition chamber has a width and length preselected in conjunction with the fixed volumetric flow rate to provide a predetermined residence time within the transition chamber sufficient to permit the activated thixotropes to reduce viscosity to the desired level. Most preferably, this residence time, determined on the basis of both theoretical calculations and empirical data, is about 0.1 seconds.

In accordance with those aspects of the invention that feature extrusion of high molecular weight polymeric thermal-cure thixotropic material, an extrusion head includes a cavity having a dimension perpendicular to the paths and into which the flow paths open at one longitudinal edge of the cavity. Side and end walls of the cavity taper narrowingly in the opposite direction to a rectangular orifice extending along the inlet-remote edge of the cavity. This extrusion head construction provides enhanced control of extruded ribbon profile and thickness.

There are thus provided a method and system for applying - e.g., spraying or extruding - high molecular weight polymeric thermal-cure thixotropic materials, such as structural epoxy, that handle the material at application temperature and pressure without requiring solvents or the like to reduce viscosity. Advantage is taken of the material characteristics to condition the material for application.

One object of the present invention, therefore, is to provide a system for extruding ribbons (having a width of more than one inch) of high molecular weight thermal-cure thixotropic material, such as single-components structural epoxy, for use as an adhesive and vapor barrier in sheet metal fabrication in which ribbon contour can be closely and selectively controlled, which reduces or eliminates voids, rippling and blistering, and in which the edges of the extruded ribbon are clearly defined. A related object of the invention is to provide a system of the described character in which ribbon contour, including profile, thickness and width, is variably but repeatably controllable.

Another object of the invention is to provide a system and method for airless spraying of high molecular weight thermal-cure thixotropic material, such as single-component structural epoxy, having particular application for controlled deposition of resin reinforcement on sheet metal panel substrates, such as automotive door and deck, and roof interior panels. Another and related object of the invention is to provide an airless spray system and method of the described character which may be readily and economically implemented in a mass production environment.

A further object of the invention is to provide nozzles or heads for controlled extrusion or spraying of thixotropic materials of the described character.

The invention, together with additional objects, features and advantages thereof, will be best understood from the following description, the appended claims and the accompanying drawings in which:

Figure 1:
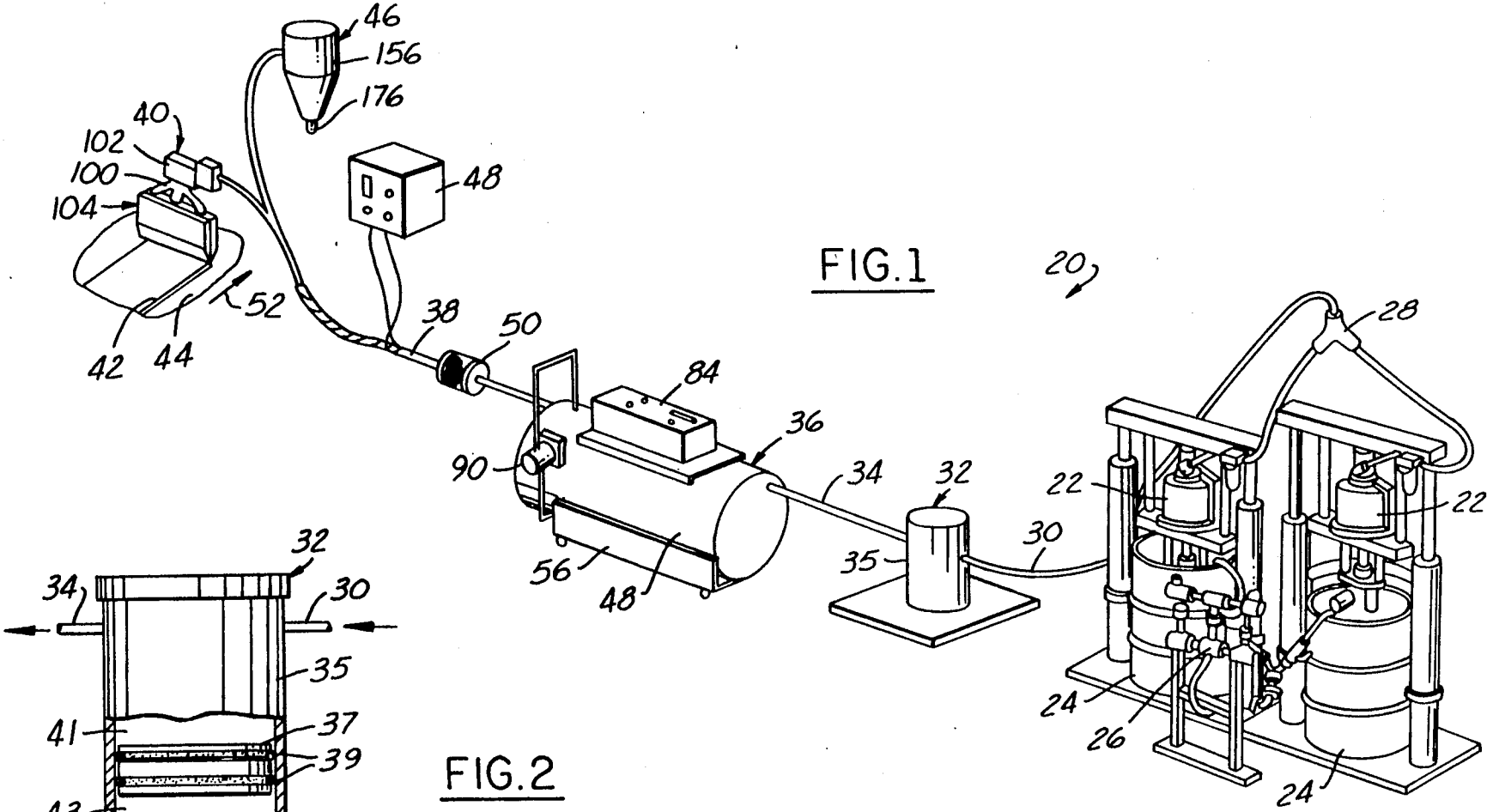
FIG. 1 is a perspective schematic diagram of a system for extruding or spraying structural epoxy in accordance with one presently preferred embodiment of the invention.

FIG. 1 illustrates a system 20 in accordance with a presently preferred embodiment of the invention as comprising a pair of air-driven positive-displacement high-pressure double-acting suction-assisted double-elevator low-shear piston pumps 22 which draw high molecular weight polymeric thermal-cure thixotropic material from respective drums 24. Valving 26, 28 is provided for allowing replacement of one material drum while operation continues at the other. Material is supplied under pressure from pumps 22 through a conduit 30 at constant volumetric flow rate to the input of a surge suppressor 32, and thence from the output of surge suppressor 32 through a conduit 34 to a material conditioning apparatus 36 for heating the material to an elevated temperature for deposition. The material is then fed from the output of conditioner 36 through a conduit 38 to an extrusion nozzle or head 40 for depositing a ribbon 42 of material on the panel 44, or to a spray nozzle or head 46 for spraying the material, for reinforcement purposes or otherwise, onto a panel spaced therefrom. Conduit 38 preferably, but not limited to, comprises a heated conduit coupled to a temperature controller 48 for maintaining material temperature between conditioner 36 and nozzles 40, 46. For spraying applications, it is preferred to position a filter 50 between material conditioner 36 and heated conduit 38 for removing particles from material flowing therethrough that might otherwise clog the spray head.

Extrusion nozzle 40 and/or spray nozzle 46 would typically be mounted on a robot arm or other suitable mechanism for generating controlled motion 52 between the head and the underlying panel 44 onto which material is to be deposited. As will be described hereinafter, both of the spray and extrusion nozzles include an on/off valve. Pumps 22 are constructed to stall upon closure of these valves, so that pressure within the material lines remains constant and ready for operation when either or both valves reopens.

Figure 2:
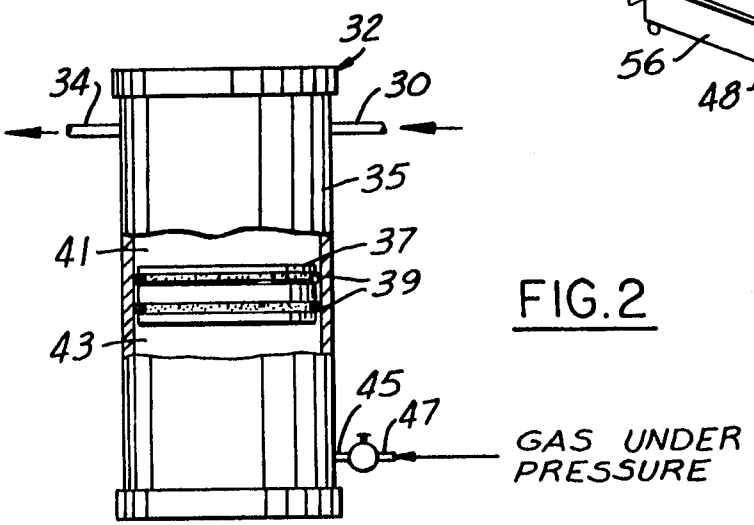
FIG. 2 is a partially sectioned elevational view of the pressure surge suppressor in the system of FIG. 1.

FIG. 2 illustrates surge suppressor 32 as comprising a hollow cylindrical canister 35 having an internally slidably mounted piston 37 that carries suitable seals 39 for dividing canister 35 into upper and lower chambers 41, 43. Upper chamber 41 has a material inlet coupled by conduit 30 and valving 28 to pumps 22 (FIG. 1), and a material outlet coupled by conduit 34 to material conditioner 36 (FIG. 1). Lower chamber 43 has an inlet 45 coupled by a manual or automatic valve 47 to a source of gas, such as nitrogen, under predetermined pressure. Thus, pressure ripples and surges at pumps 22 are absorbed by motion of piston 36 against the pressure of gas in lower chamber 43 as the epoxy material passes through upper chamber 41 of surge suppressor 32.

Figure 3:
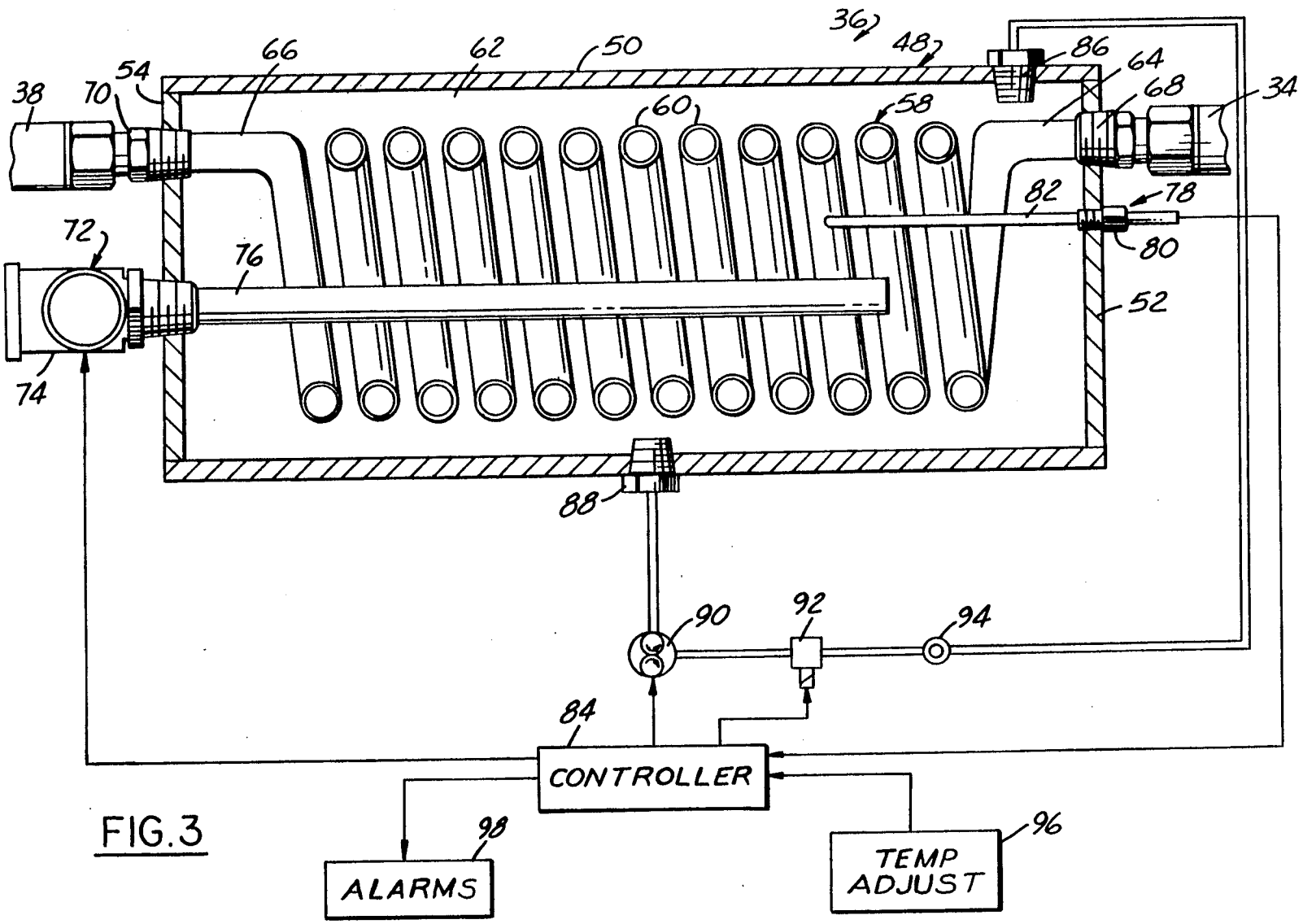
FIG. 3 is a partially schematic and partially fragmented sectional view of the material heating and conditioning apparatus in the system of FIG. 1.

Referring to FIG. 3, material conditioner 36 comprises a hollow cylindrical enclosure 48 having a sidewall 50 and a pair of axially opposed endwalls 52, 54. Enclosure 48 is carried by a wheeled cart 56 (FIG. 1). A spirally-coiled tube 58, of stainless steel tube stock or the like, has a multiplicity of coils 60 at uniform diameter and pitch substantially coaxially disposed within the interior 62 of enclosure 48. Tube 58 is suspended within enclosure 48 by the axially opposed coil inlet and outlet ends 64, 66. Suitable fittings 68, 70 are carried by endwalls 52, 54 and respectively connect tube ends 64, 66 to conduits 34, 38. An electric heater 72 has a base 74 approximately centrally mounted on enclosure endwall 54 and a heater element 76 extending therefrom into enclosure interior 62 substantially centrally of coils 60. A temperature sensor 78 has a base 80 substantially centrally mounted on enclosure endwall 52, and has a temperature probe 82 extending into enclosure volume 62 substantially centrally of tube coils 60. Heater 72 and temperature sensor 78 are connected to control electronics 84 (FIGS. 1 and 3).

An inlet fitting 86 and an outlet fitting 88 are respectively disposed on the upper and lower portions of sidewall 50 for circulating heat transfer fluid through the hollow interior 62 of enclosure 48. Outlet fitting 88 is connected to inlet fitting 86 by suitable fluid conduits in a closed loop through a pump 90, a solenoid valve 92 and a flow indicator 94. Pump 90 and solenoid valve 92 each receive control inputs from controller 84. Controller 84 also receives an input from a temperature adjustment mechanism 96 for operator selection of temperature within enclosure 48 to which epoxy passing through coiled tube 58 is to be raised, and has an output connected to suitable alarms 98 for indicating over-temperature, under-temperature and other desired alarm conditions. The heat transfer fluid preferably comprises a mixture of glycol and water, or other suitable mixture depending upon temperature to which the epoxy is to be raised.

In general operation of material conditioner 36, the desired deposition temperature of the thixotropic material is normally specified by a process engineer based upon technical data for the particular material in question, empirical design and operating experience, and other factors. With the desired temperature set at adjustment mechanism 96, the one-part thermal-cure material, such as structural epoxy, is then propelled through conditioner 36 under pressure from pumps 22. As the material flows through coils 60, heater 72 is operated by controller 84 so as to heat the heat transfer fluid within enclosure 48, with the heat transfer fluid conducting such heat energy to coils 60 and thence to the epoxy material. Temperature probe 78 provides electrical signals to controller 84 indicative of heat transfer fluid temperature. Controller 84, which preferably comprises a microprocessor-based controller, contains suitable programming for operating heater 72, pump 90 and solenoid valve 92 to maintain heat transfer fluid within enclosure 48 surrounding coils 60 at the desired operating temperature. Material conditioner 36 per se is the subject of copending application Ser. No. 223,630, filed July 25, 1988, now U.S. Pat. No. 4,892,573, and assigned to the assignee hereof, to which reference is made for further structural and functional details.

Extrusion nozzle 40 (FIGS. 1 and 4–5) includes an intake manifold 100 that receives material from conditioner 36 and conduit 38 through a full-flow (on/off) air-operated inlet valve 102 (FIG. 1). An extrusion head 104 depends from manifold 100 and comprises a block 106 having an elongated pocket 108 machined along one planar rectangular block face 110. A flat rectangular plate 112 is affixed to block 106 over face 110 and is separated therefrom by a shim 114 so as to cooperate with pocket 108 to form an elongated material cavity 116. Plate 112 has longitudinal reinforcing ribs 118 welded or otherwise externally affixed thereto, and is securely fastened to block 106 by an array of screws 120. Shim 114 is generally C-shaped in contour, opening downwardly from cavity 116 so as to form a elongated rectangular outlet orifice 122 between the opposed lower edges of plate 112 and block 106. Orifice 122 is defined between the longitudinally opposed parallel free edges of shim 114, the surfaces of plate 112 and block 106 being flat and parallel in this region.

Figure 5:
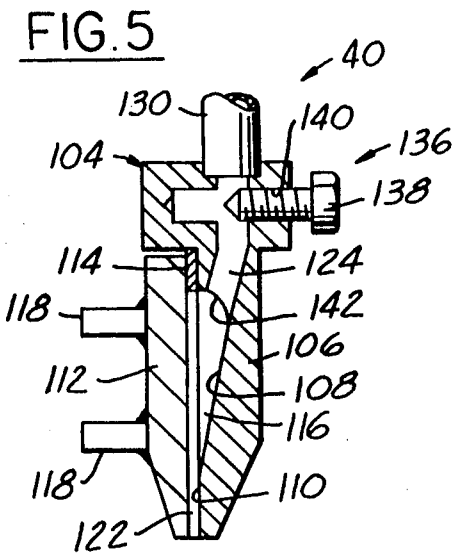
FIG. 5 is a sectional view taken substantially along the line 5—5 in FIG. 4.
Figure 4:
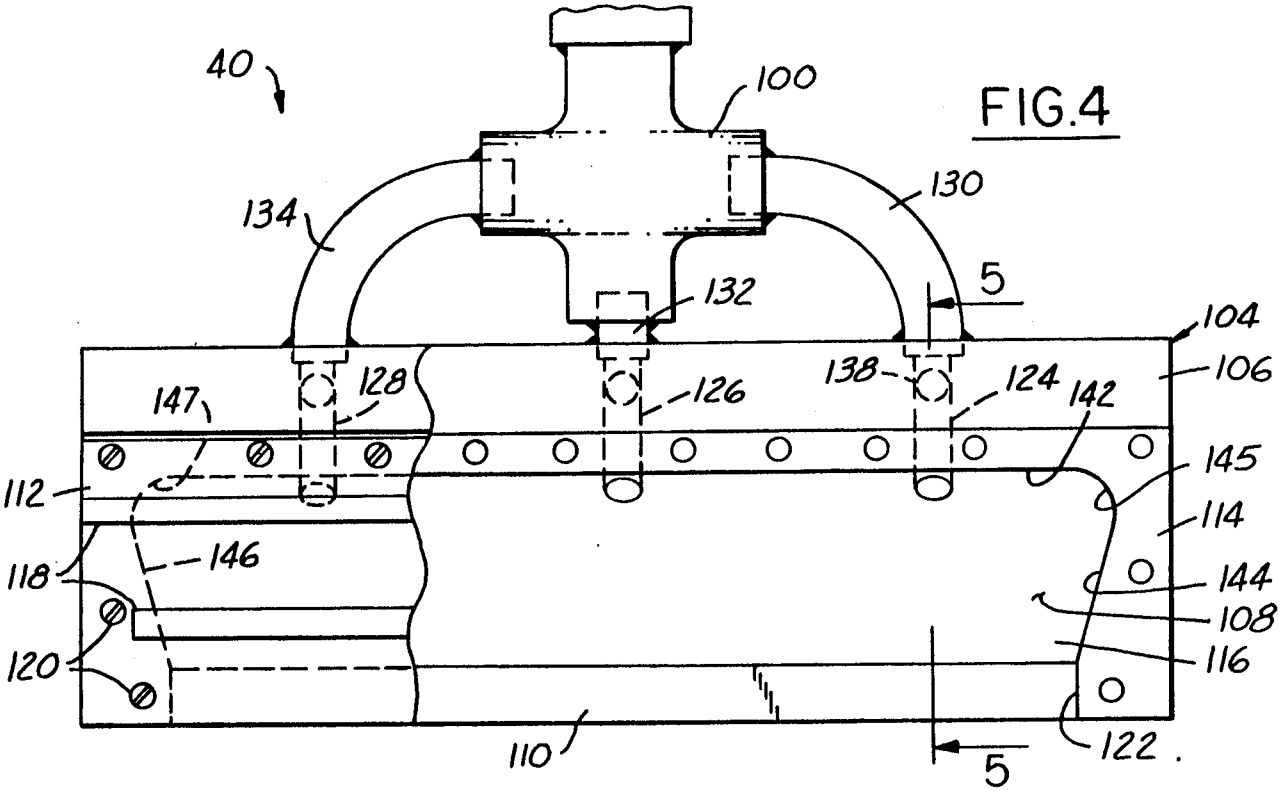
FIG. 4 is a partially sectioned elevational view of the extrusion nozzle in the system of FIG. 1.

Three inlet passages 124, 126 and 128 of uniform circular cross section extend into cavity 116 from the upper or orifice-remote edge of block 106 in a downward direction as viewed in FIGS. 4–5 generally parallel to outlet orifice 122. Passages 124, 126 and 128 are parallel to each other and perpendicular to the elongated dimension of cavity 116. Each passage 124–128 is connected by a corresponding pipe 130, 132, 134 to an outlet of manifold 110, such outlets being orthogonal to each other and to the inlet from valve 102 (FIG. 1). It will be noted that passage 126 and pipe 132 are positioned centrally of the longitudinal dimension of cavity of 116, as best seen in FIG. 4, and passages 124, 128 and associated pipes 130, 134 are at uniform spacing on opposed lateral sides of central passage 126. Each passage 124–126 in block 104 has an associated flow control adjustment 136 (FIG. 5) comprising a cone-point setscrew threadably received in block 106 and orthogonally adjustably extending into the associated passage 124–128.

In accordance with an important feature of extrusion nozzle 40, pocket 108 in block 106 is contoured in cooperation with passages 124–128 and orifice 122 to convert turbulent or semi-turbulent flow of material entering cavity 116 from passages 124–128 into smooth laminar flow exiting nozzle orifice 122. It is in this way, as will be described in connection with FIG. 6, that nozzle 40 not only obtains well-defined edges at the ribbon deposited by the nozzle, but also provides enhanced profile and contour control through manipulation of flow adjustments 136. Rippling and blistering are also avoided, in contrast to previous attempts to extrude and deposit ribbons having a width of one inch or more. More specifically, pocket 108 and cavity 116 have a concave upper edge 142 into which passages 124–128 open at a slight angle with respect to the plane of face 110. The opposed side edges 144, 146 of pocket 108 are reversed with respect to top edge 142, being coupled thereto by the smooth concave blends 145, 147, and are angled equally toward each other, so that the longitudinal dimension of pocket 108 and cavity 116 tapers narrowingly, as best seen in FIG. 4, between inlet passages 124–128 at the upper cavity edge and outlet orifice 122 at the lower cavity edge. Further, as best seen in FIG. 5, the backwall of pocket 108 slopes downwardly towards surface 110, so that the depth of cavity 116 from surface 110 likewise tapers narrowingly between the spaced cavity inlets at upper edge 142 and the cavity outlet at orifice 122. Thus, material entering cavity 116, particularly from outer inlet passages 124, 128 flows laterally outwardly toward side edges 144, 146, and is redirected downwardly toward orifice 122 by the concave blends 145, 147 and tapering side edges 144, 146.

Figure 6:
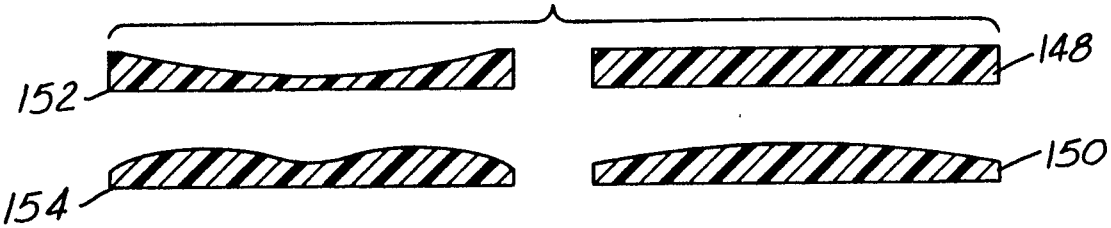
FIG. 6 is a schematic illustration of exemplary ribbon profiles which may be obtained employing the extrusion nozzle of FIGS. 4–5.

The ribbon contours schematically illustrated in FIG. 6 are exemplary of contours which may be obtained through selective manipulation of flow adjustments 136. For example, ribbon profile 148 is substantially rectangular, having a flat upper surface and sharp well-defined side edges. By decreasing flow through outer passages 124, 128, a crowned profile 150 may be obtained. On the other hand, by decreasing flow through central passage 126, a concave profile 152 may be obtained, while decreasing flow in center passage 126 combined with increasing flow in outer passage 124, 128 may obtain a double-crowned profile 154. Other profiles may likewise be obtained through manipulation of flow adjustments 136.

Figure 7:
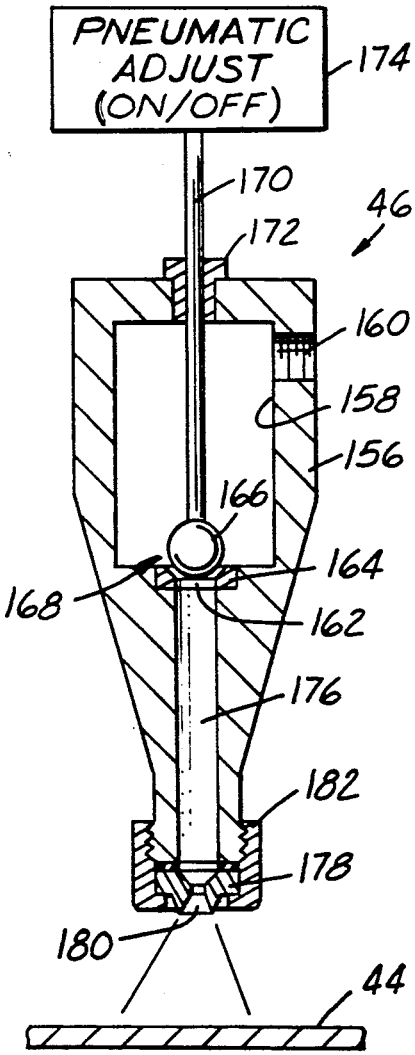
FIG. 7 is a partially schematic sectional view of the airless spray nozzle illustrated in FIG. 1.

FIG. 7 illustrates nozzle 46 for airless spraying of high molecular weight polymeric thermal-cure thixotropic material in accordance with one embodiment of the present invention. Nozzle 46 includes an intake manifold 156 having an internal cavity 158 with an inlet opening 160 for connection to conduit 38 (FIG. 1). The outlet 162 of cavity 158 is defined by an annular valve seat 164 in cooperation with a ball element 166, which together comprise a ball valve 168. Ball 166 is mounted on a shaft 170 which extends through cavity 158 and through a gland 172 to a pneumatic on/off drive 174. Drive 174 includes suitable means for adjusting the open position of valve 168 illustrated in FIG. 7. The body of nozzle 146 extends axially from valve 168 through a cylindrical transition chamber 176 to a spray tip 178 having an outlet orifice 180. Tip 178 is mounted on the nozzle body by the clamp nut 182. Tip 178 may be of any suitable conventional type for obtaining desired material spray pattern, such as a flat spray pattern that has a width at substrate 44 forty times the diameter of the spray orifice. For example, a 0.023 inch orifice in one embodiment of the invention puts a one-inch fan spray onto a substrate about three inches from the spray head.

In accordance with a key feature of nozzle 46 illustrated in FIG. 7, valve 168 functions not only as an on/off valve for material passing through nozzle 46, but also imparts shear stresses in the open position to material flowing therepast so as to activate the thixotropes in the material entering transition chamber 176. In accordance with this key feature of the present invention, transition chamber 176 has a diameter (preferably uniform) and length in the direction of material flow sufficient to permit thixotropes in the material activated by valve 168 to decrease viscosity of the materials sufficiently for airless spraying at tip 178. More specifically, and for spraying at predetermined constant flow rate in accordance with the preferred implementation of the present invention, pumps 22 supply material at the desired constant flow rate, and transition chamber 176 has a diameter and length selected to provide a predetermined residence time of material in the transition chamber at the flow rate of the material pumps. The residence time within chamber 76, as well as the separation of ball 166 from seat 164, are selected empirically for a particular material, deposition temperature and other system parameters specified by the process engineer.

In an exemplary working embodiment of the invention employing structural epoxy marketed under the designation or catalogue No. HC 7344 by PPG Industries and deposited at a temperature of above 120° F., nozzle 46 comprises a Model 1200 Series nozzle marketed by Sealant Equipment Corporation, to which transition chamber 176 was added. Spray tip 178 comprises a Model 0944 Series tip marketed by the assignee hereof. For a spacing of about 0.890 inch between ball 166 and seat 164, chamber 176 is dimensioned to provide a material residence time of about 0.1 seconds between valve 168 and tip 178. As the material is sprayed from orifice 180 into ambient air at atmospheric pressure toward to deposition substrate 44, shear stresses on the material begin to reverse the thinning process, so that material begins to thicken and is again thixotropic upon deposition on substrate 44. The substrate may then be cured at suitable elevated temperature to trigger hardening of the structural epoxy, and thereby provide enhanced structural stiffness to the panel in accordance with the preferred implementation of nozzle 46.

Figure 8:
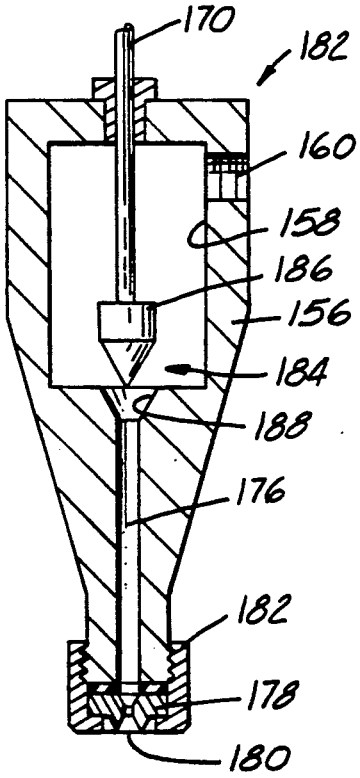
FIG. 8 is a fragmentary view of a modified spray nozzle.
Figure 9:
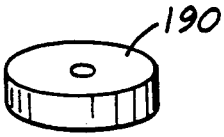
FIGS. 9 and 10 are schematic illustrations of further modifications to the preferred spray nozzle configuration of FIG. 7.
Figure 10:
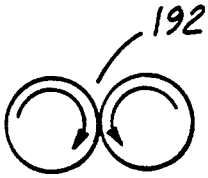

FIG. 8 illustrates a modified nozzle 182 in which the ball valve element 166 and complementary seat 164 (FIG. 7) are replaced by a valve 184 comprising a conical pin 186 mounted on shaft 170 and a complementary conical seat 188 mounted on manifold 156. Other mechanisms for imparting the initial preshear to the material prior to entry into transition chamber 176 may also be employed, such as an orifice shear 190 (FIG. 9) or a mechanical shear 192 (FIG. 10). Of course, the latter two modifications do not provide the combined on/off and readily adjustable shear features of the valves 168, 184 in FIGS. 7 and 8.

There has thus been provided a system for depositing thixotropic thermally-curable single-part material both as an extruded ribbon for panel assembly and sealing operations, and as a sprayed patch or area having particular utility for sheet metal panel reinforcement. Insofar as applicant is aware, the art has yet to propose, prior to applicant's invention, a technique for spray-deposition of thixotropic material which does not involve use of compressed air for atomizing the material and/or involve solvents to reduce the viscosity thereof. Thus, the system and method for spray deposition of thixotropic material in accordance with the present invention provides significantly enhanced versatility and economy as compared with comparable prior art devices. Likewise, the extrusion system of the present invention provides ribbons of controllable profile and contour, and is much more versatile and reliable than are comparable extrusion devices in systems heretofore proposed. It will be appreciated that the three-entry extrusion nozzle illustrated in FIGS. 4–5 is merely exemplary of this aspect of the invention, and may be enlarged or ensmalled indefinitely (in coordination with material flow capacity) to deposit ribbons of any desired width.

The principles of the present invention are likewise not in any way limited to specific exemplary materials hereinabove discussed, or to specific techniques for increasing material temperature. Some thixotropic (filled) epoxies of high molecular weight and viscosity may require thermal assistance at the pump for removal from the storage drum. Many types of controlled thermal assistance may be employed at the pump and/or at various stages of the system without departing from the present invention.

The invention claimed is:

1. A system for applying a material to a substrate that comprises a source of an epoxy-based thixotropic material having a viscosity of at least about 1000 centipoise, means coupled to said source for supplying the material under pressure of at least 1500 psi, means for applying the material to a substrate, and conduit means for feeding the material from said supplying means to said applying means; said means for applying the material to the substrate comprising an airless spray head that includes:

a manifold having an inlet coupled to said conduit means and an outlet, shear means positioned at said manifold outlet for imparting shear stresses to thixotropes in material exiting said manifold outlet, a tip having a spray orifice, and means forming a transition chamber extending from said shear means to said tip, said transition chamber having a length in the direction of material flow sufficient to permit thixotropes in the material activated by said shear means to decrease viscosity in the material sufficiently for airless spraying at said tip as discrete material droplets in a pattern of a size substantially larger than diameter of said orifice.

2. The system set forth in claim 1 wherein said shear means comprises a valve seat at said manifold outlet, a valve element, and means positioning said valve element with respect to said seat so as to impart said shear stresses to thixotropes in the material passing therebetween into said transition chamber.

3. The system set forth in claim 2 wherein said element-positioning means comprises means for closing said valve element against said seat to terminate flow of material through said spray head.

4. The system set forth in claim 3 further comprising means for adjusting position of said valve element with respect to said seat.

5. The system set forth in claim 4 wherein said valve element comprises a ball.

6. The system set forth in claim 4 wherein said valve seat and element comprise complimentary conical means.

7. The system set forth in claim 1 wherein said shear means comprises a shear orifice.

8. The system set forth in claim 1 wherein said shear means comprises mechanical shear means.

9. The system set forth in claim 1 for spraying the material at predetermined constant flow rate, said supplying means including means for supplying the material at said predetermined constant flow rate, and wherein said transition chamber has a diameter and length selected to provide a predetermined residence time of material in said transition chamber at said predetermined flow rate.

10. The system set forth in claim 9 wherein said transition chamber has a constant diameter.

11. The system set forth in claim 10 wherein said residence time is about 0.1 seconds.

12. The system set forth in claim 1 wherein said shear means comprises a on/off valve.

13. The system set forth in claim 12 wherein said supplying means comprises pump means having drive motors which stall upon closure of said on/off valve.

14. The system set forth in claim 13 wherein said pumps comprises piston pumps.

15. The system set forth in claim 14 further comprising a surge suppressor positioned between said pump means and said applying means for modulating pressure surges from said pump means.

16. The system set forth in claim 15 wherein said surge suppressor comprises a canister having a piston freely slidable therewithin, means feeding gas under pressure to said canister on one side of said piston, and means forming a material inlet and a material outlet in said canister in the opposing side of said piston.

17. The system set forth in claim 13 wherein said conduit means includes means for heating material in said conduit means to an elevated temperature above ambient.

18. The system set forth in claim 13 further comprising filter means connected by said conduit means between said heating means and said spray head.

* * * * *